United States Patent [19]

Harada

[11] 4,408,201

[45] Oct. 4, 1983

[54] ELECTRO-OPTIC DISPLAY DEVICE USING PHASE TRANSITION MODE LIQUID CRYSTAL

[75] Inventor: Takamasa Harada, Tokyo, Japan

[73] Assignee: Kabushiki Kaisha Daini Seikosha, Tokyo, Japan

[21] Appl. No.: 218,183

[22] Filed: Dec. 19, 1980

[30] Foreign Application Priority Data

Dec. 25, 1979 [JP] Japan ..... 54/168644

[51] Int. Cl.[3] ..... G09G 3/36

[52] U.S. Cl. ..... 340/784; 340/805; 350/346

[58] Field of Search ..... 340/805, 784; 350/346

[56] References Cited

U.S. PATENT DOCUMENTS 4,048,633 9/1977 Sano ..... 340/805
4,100,540 7/1978 Fujita et al. ..... 340/805
4,186,395 1/1980 Fujita et al. ..... 340/805
4,257,045 3/1981 Miles ..... 340/805
4,317,115 2/1982 Kawakami et al. ..... 350/346

*Primary Examiner*—Marshall M. Curtis
*Attorney, Agent, or Firm*—Robert E. Burns; Emmanuel J. Lobato; Bruce L. Adams

[57] ABSTRACT

A display device having an electro-optical display element such as a phase transition mode liquid crystal and a driving circuit. The driving circuit applies two square voltage waves to the electro-optical display element. Each of these waves has an effective voltage and a time interval of zero volts. One of the waves is applied to the selected display picture elements of the electro-optical display element and gives the selected elements a first state, e.g., a homeotropic state. The other is applied to the nonselected display picture elements and gives the nonselected elements a second state, e.g., a focal-conic state.

5 Claims, 13 Drawing Figures

ELECTRO-OPTIC DISPLAY DEVICE USING PHASE TRANSITION MODE LIQUID CRYSTAL

BACKGROUND OF THE INVENTION

This invention relates generally to an electro-optical display device, and more particularly, to a phase transition mode liquid crystal display device.

In a twisted nematic liquid crystal display, an LED display or the like, predetermined voltages e.g., about 3 volts, are applied to selected display picture elements and 0 volts are applied to nonselected display picture elements in order to obtain the desired display information. However, in a kind of electro-optical display device such as a phase transition mode liquid crystal display device, desired voltages other than 0 volts may be applied to the nonselected display picture elements, while predetermined voltages are applied to the selected elements. The phase transition mode liquid crystal display element may take three phases, i.e., a homeotropic state, which is referred to as an H-state hereinafter, a focal-conic state referred to as an F-state hereinafter, and a granjuane state referred to as a G-state hereinafter, according to the applied voltage. The G-state is a transparent state which is caused under a non-electric field condition. The G-state is changed into the F-state, which is a light scattering state, when a voltage is applied thereto. The F-state is changed into the H-state, which is a transparent state, when a stronger voltage is applied thereto. It is possible to display information by using the transparent G-state and the light scattering F-state. In this kind of display system, a static driving method similar to that for driving a usual twisted nematic mode liquid crystal display device may be used. Namely, a voltage of square wave shape having an effective value $\pm V_F$, which holds the liquid crystal in the F-state, is applied between selected display segment electrodes and a common electrode and zero volts are applied between nonselected display segment electrodes and the common electrode. However, it takes a relatively long time for the transition from the F-state to the G-state and the display exhibits an inferior transparency in the G-state.

Generally, a digital integrated circuit is used as a liquid crystal driving circuit in order to reduce the power consumption and to increase the space for other elements. In the digital integrated circuit, the voltage level for driving the liquid crystal is obtained by boosting or dropping the source voltage using condensers, so that the level is limited to an integral number of times or integral fraction of the voltage of a power source, e.g., the voltage of a battery.

According to the electric property of the phase transition mode liquid crystal, the voltage needed to exhibit the F-state or the H-state is not equivalent with the voltage level obtained by boosting or dropping the source voltage. The picture quality, e.g., the contrast, of the phase transition mode liquid crystal element depends on an applied effective voltage.

SUMMARY OF THE INVENTION

It is therefore an object of the invention to provide an improved display device.

Another object of the invention is to provide a display device which is driven by a simplified circuit.

Another object of the invention is to provide a display device having a driving circuit which makes effective utilization of electrical energy.

A further object of the invention is to provide an improved display device using plural phases which are caused by applying desired voltages other than zero volts to obtain the respective phases.

The above and further objects and novel features of the invention will more fully appear from the following detailed description of the description when the same is read in connection with the accompanying drawing. It is to be expressly understood, however, that the drawing is for purpose of illustration only and is not intended as a definition of the limits of the invention.

DETAILED DESCRIPTION OF THE INVENTION

Figure 1:
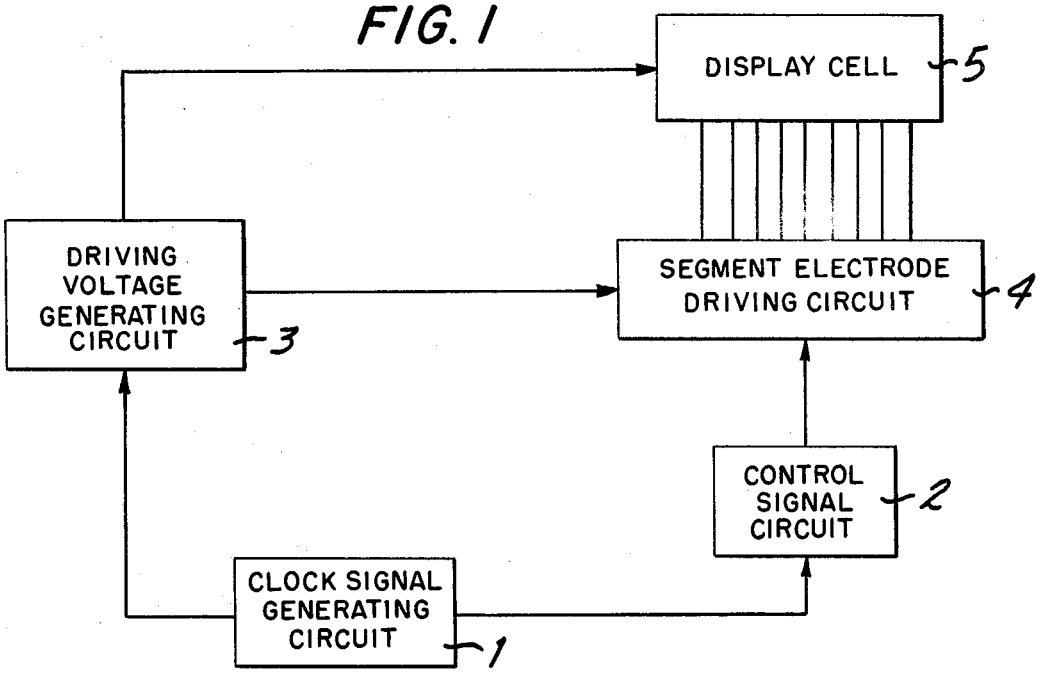
FIG. 1 is a block diagram of a preferred embodiment of the invention.

An embodiment of the invention is shown in FIG. 1. In this figure, numeral 1 shows a clock signal generating circuit for generating a constant clock signal. The clock signal is supplied to a control signal circuit 2 and a driving voltage generating circuit 3. The control signal circuit 2 generates a control signal simultaneous with the clock signal supplied by the clock signal generating circuit 1, that is, the control signal circuit 2 generates an information signal indicative of either a select state or a nonselect state of display segment electrodes corresponding to the time or other information to be displayed, and supplies the control signal to a segment electrode driving circuit 4. The driving voltage generating circuit 3 generates three fundamental driving voltage square waves and supplies two of the three waves to the segment electrode driving circuit 4 and the remaining one to a common electrode of a display section or cell 5.

Figure 2:
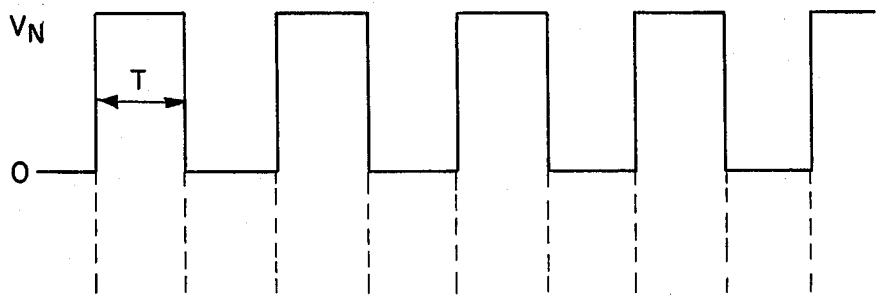
FIG. 2 is a waveform of a voltage applied to a common electrode of a display cell.
Figure 3:
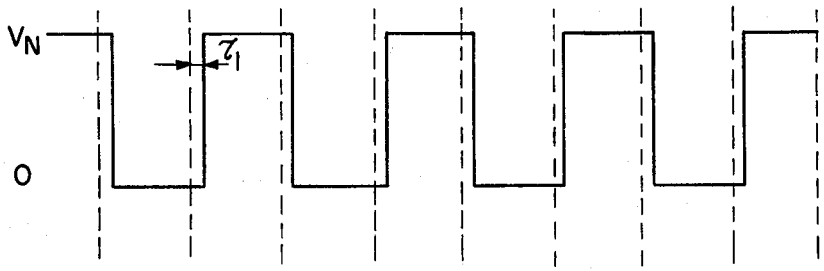
FIG. 3 is a waveform of a voltage applied to selected segments in display electrodes of the display cell.
Figure 4:
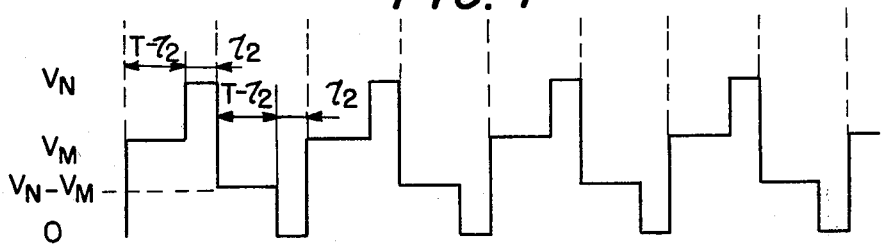
FIG. 4 is a waveform of a voltage applied to nonselected segments in the display electrodes.

The first square voltage wave [O, $V_N$] which has an amplitude of $V_N/2$ and a $\frac{1}{2}$ duty ratio, as shown in FIG. 2, is always applied to the common electrode of the display cell 5. The second square voltage wave [$V_N$, O] has an amplitude of $V_N/2$, a $\frac{1}{2}$ duty ratio and a phase shift of time $\tau_1$ within a half period of the first wave as against a voltage wave 180° out of phase with the first wave, as shown in FIG. 3. The third square voltage wave has four periodic voltage levels, i.e., $V_M$, $V_N$, $V_N-V_M$ and 0, as shown in FIG. 4. The level "$V_M$" exists during an interval "T-$\tau_2$" after the level of the first wave takes "$V_N$". "T" is equal to a half period of the first wave (as shown in FIG. 2) and has a relation to $\tau_2$ represented by the following relationship, $0<\tau_2<T$. Next, the level "$V_N$" appears for an interval "$\tau_2$". When the level of the first wave takes zero volts, the level "$V_N-V_M$" appears for an interval "T-$\tau_2$" and after that the level "0" appears for a remaining interval "$\tau_2$". The relation between the voltage levels $V_M$, $V_N$, an effective value $V_0$ which gives a selected state to the electro-optical display element, e.g., the H-state to the phase transition mode liquid crystal, and an effective value $V_1$ which gives a nonselected state, e.g., the F-state, is represented by the following relationships, $$V_1<V_M<V_N,\ V_N>V_0.$$

The second and third square voltage waves are selected by the segment electrode driving circuit 4 according to the control signal and are applied to the desired display electrodes of the display cell 5.

Figure 5:
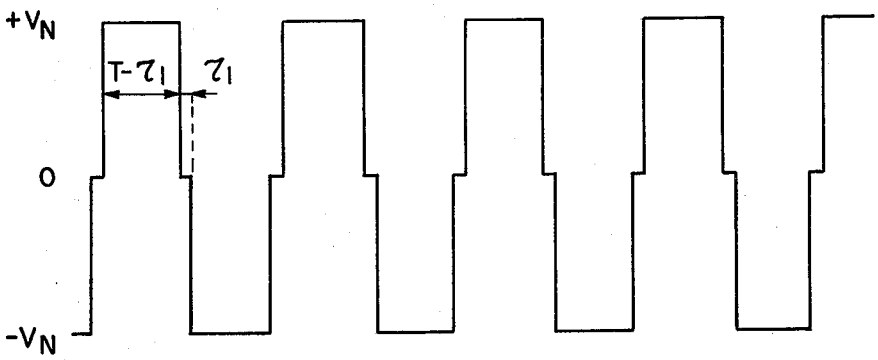
FIG. 5 is a waveform of a voltage applied between the common electrode and the selected segments.
Figure 6:
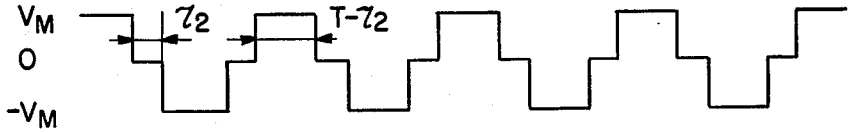
FIG. 6 is a waveform of a voltage applied between the common electrode and the nonselected segments.

Between those of the display electrodes in the selected state and the common electrode, a square voltage $\pm V_N$ is produced which has an amplitude of $V_N$ and a time interval "$\tau_1$" of zero volts level, as shown in FIG. 5. Between those of the display electrodes in the nonselected state and the common electrode, a square voltage $\pm V_M$ is produced which has an amplitude of $V_M$ and a time interval "$\tau_2$" of zero volts level, as shown in FIG. 6.

The effective value of the voltage applied to the display element is calculated as follows.

Effective value:

$$\left\{\frac{1}{2T}\int_0^{2T} V^2(t)dt\right\}^{\frac{1}{2}}$$

Effective voltage in the selected state:

$$\left[\frac{1}{2T}\left\{\int_0^{T-\tau_1}(V_N)^2dt+\int_T^{2T-\tau_1}(-V_N)^2dt\right\}\right]^{\frac{1}{2}}$$

$$=\left[\frac{1}{2T}\{V_N^2(T-\tau_1)+V_N^2(2T-\tau_1-T)\}\right]^{\frac{1}{2}}$$

$$=V_N\left(1-\frac{\tau_1}{T}\right)^{\frac{1}{2}}$$

The effective voltage in the selected state is equal to the voltage $V_0$.

$$V_0=V_N(1-\tau_1/T)^{\frac{1}{2}}$$

Effective voltage in the nonselected state:

$$\left[\frac{1}{2T}\left\{\int_0^{T-\tau_2}(V_M)^2dt+\int_T^{2T-\tau_2}(-V_M)^2dt\right\}\right]^{\frac{1}{2}}$$

$$=\left[\frac{1}{2T}\{V_M^2(T-\tau_2)+V_M^2(2T-\tau_2-T)\}\right]^{\frac{1}{2}}$$

$$=V_M\left(1-\frac{\tau_2}{T}\right)^{\frac{1}{2}}$$

The effective voltage in the nonselected state is equal to the voltage $V_1$.

$$V_1=V_M(1-\tau_2/T)^{\frac{1}{2}}$$

The values of "$\tau_1$" and "$\tau_2$" can be determined independently of one another.

The "$\tau_1$" and the "$\tau_2$" are properly determined so that the effective values in the selected and nonselected states are equal to the voltages $V_0$ and $V_1$ respectively. Consequently, it is possible to drive the electro-optical display element such as a phase transition mode liquid crystal utilizing the F-state and the H-state with short response time and high contrast.

Because the voltage waves applied between the display segment electrodes and the common electrode have zero volts during the interval $\tau_1$ or $\tau_2$, the electric charge collected between the display segment electrodes and the common electrode may be discharged through the power source. This contributes significantly to the long life of the power source and effectively conserves power consumption.

Figure 7:
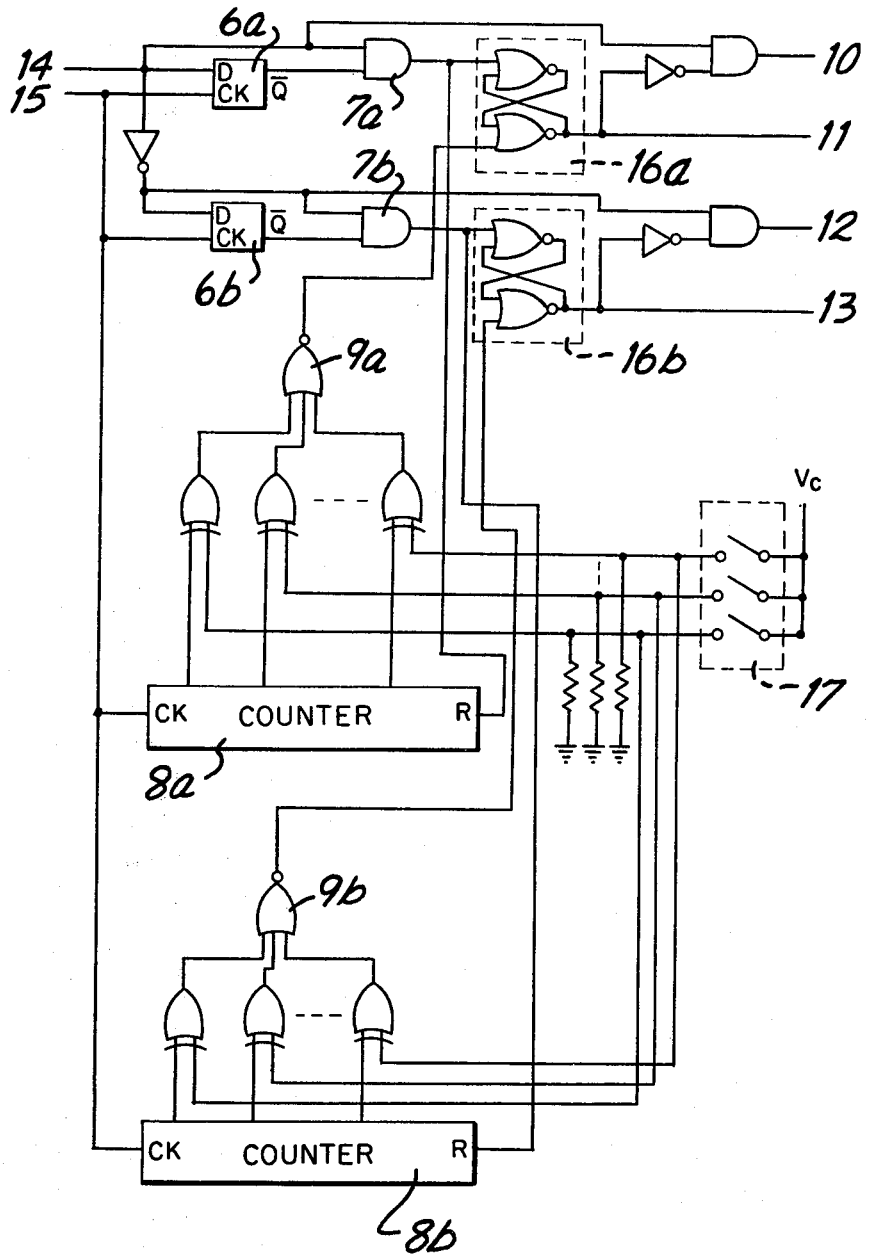
FIG. 7 is a circuit diagram showing a part of an embodiment of a driving voltage generating circuit for generating control signals to produce first, second and third driving voltage waves.

In FIG. 7, showing a part of an embodiment of the driving voltage generating circuit 3, control signals for making the third square voltage wave are generated at terminals 10, 11, 12 and 13.

Figure 8:
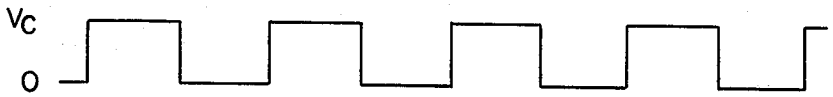
FIG. 8 is a waveform of a voltage applied an input terminal 14 in FIG. 7.

An input applied to a terminal 14, which is referred to as an A signal hereinafter, is in phase with the first square voltage wave and oscillates between 0 volts and the power source voltage $V_C$ of a digital IC, as shown in FIG. 8. An input applied to a terminal 15, which is referred to as a B signal hereinafter, is a clock signal produced by the clock signal generating circuit 1 or a signal obtained by dividing down the clock signal. The B signal is a square voltage wave oscillating between 0 volts and the power source voltage $V_C$.

A pulse having a half wave length of the B signal is produced by a D-flip-flop 6*a* and an AND gate 7*a* at the rising edge timing of the A signal, and fed to a set terminal of an R-S flipflop 16*a* and a reset terminal of a counter 8*a* to thereby set the R-S flipflop 16*a* and reset the counter 8*a*.

Similarly, a pulse having a half wavelength of the B signal is produced by a D-flipflop 16*b* and an AND gate 7*b* at the rising edge timing of a signal 180° out of phase with the A signal, and fed to a set terminal of an R-S flipflop 16*b* and a reset terminal of a counter 8*b* to thereby set the R-S flipflop 16*b* and reset the counter 8*b*.

The counters 8*a* and 8*b*, once reset, start counting again at the next rising edge timing of the B signal.

When the outputs of the counters 8*a*, 8*b* coincide with the desired binary value set by switches 17, a pulse having a half wavelength of the B signal is produced at the output terminals of NOR gates 9a, 9b and fed to the reset terminals of the R-S flipflops 16a and 16b.

On this occasion the R-S flipflops 16a and 16b are reset.

Figure 9:
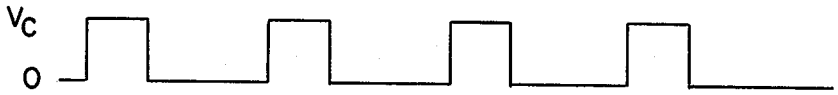
FIG. 9 is a waveform of a voltage produced at an output terminal 11 in FIG. 7.
Figure 11:
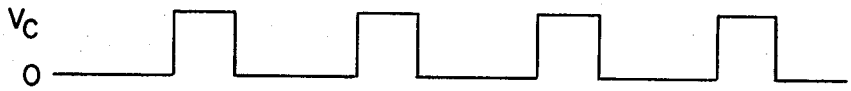
FIG. 11 is a waveform of a voltage produced at an output terminal 13 in FIG. 7.

The outputs from the R-S flipflops 16a and 16b are produced at the terminals 11 and 13 as shown in FIG. 9 and 11.

Figure 10:
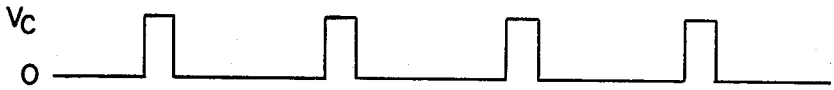
FIG. 10 is a waveform of a voltage produced at an output terminal 10 in FIG. 7.
Figure 12:
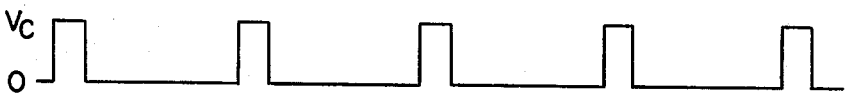
FIG. 12 is a waveform of a voltage produced at an output terminal 12 in FIG. 7.

The inverted output of the R-S flipflop 16a and the A signal are fed to an AND gate, so that the signal shown in FIG. 10 is produced at the terminal 10. In a similar manner, the inverted output of the R-S flipflop 16b and the inverted A signal are fed to an AND gate, so that the signal shown in FIG. 12 is produced at the terminal 12.

Figure 13:
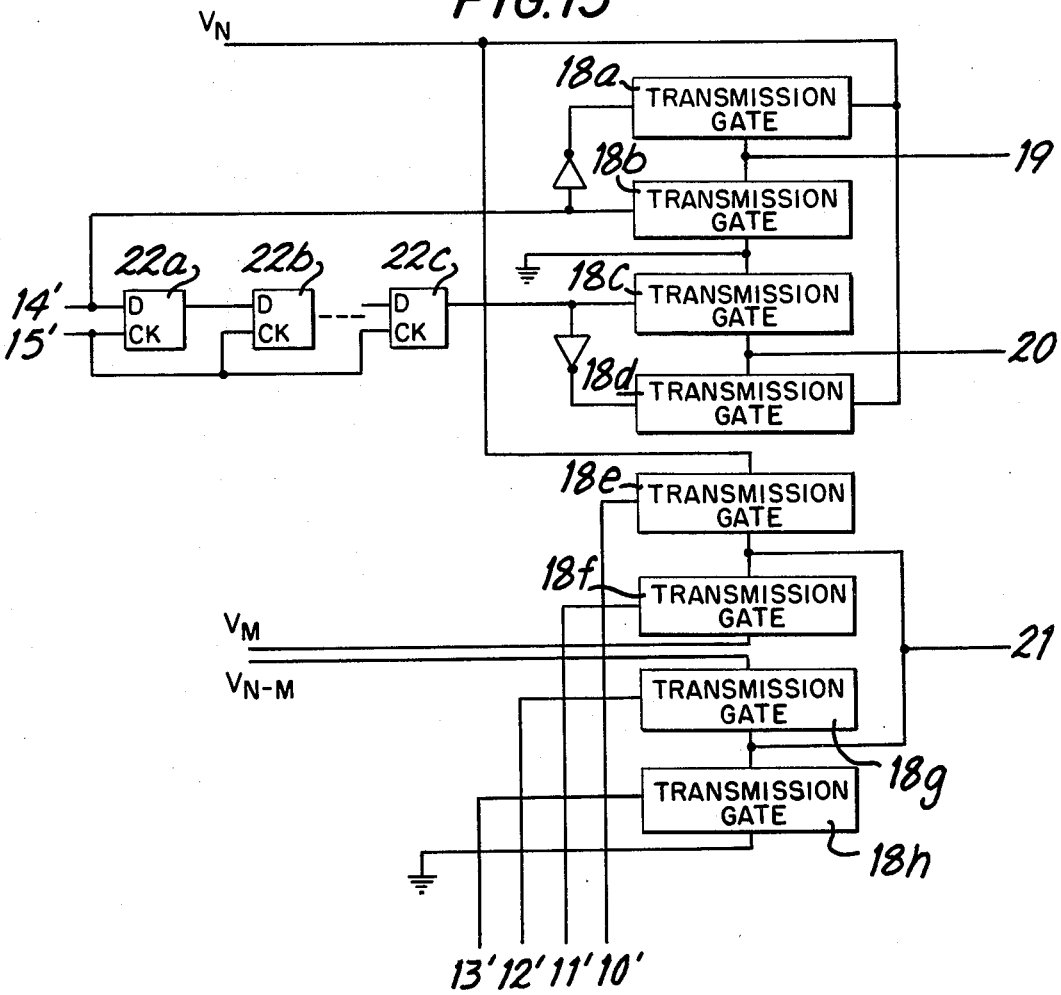
FIG. 13 is a circuit diagram showing another part of an embodiment of a driving voltage generating circuit for selecting and composing voltage levels according to the control signals.

The four outputs of these terminals 10, 11, 12 and 13 are applied to terminals 10', 11', 12' and 13' shown in FIG. 13, respectively. The voltage levels of $V_N$, $V_M$, $V_N-V_M$ and 0 volts are selected and composed analogically by transmission gates 18e, 18f, 18g and 18h in accordance with the four outputs, and the output is produced at a terminal 21. The output is the third square voltage wave shown in FIG. 4.

The A signal and the B signal are fed to input terminals 14' and 15' in FIG. 13, respectively.

The voltages $V_N$ and 0 volts are selected and composed in transmission gates 18a, 18b by the A signal and the inverted A signal, and the output is produced at a terminal 19 as the first square voltage wave shown in FIG. 2.

Several D-flipflops 22a, 22b, 22c are provided in order to produce a signal having a desired phase shift relative to the A signal, which is referred to as a C signal hereinafter. The voltages 0 volts and $V_N$ are selected and composed in transmission gates 18c, 18d by the C signal and the inverted C signal, so that the second square voltage wave shown in FIG. 3 is produced at a terminal 20.

Three square voltage waves are produced by such a driving voltage generating circuit.

It should be noted that the invention may be adapted to not only a phase transition mode liquid crystal display device, but also other display devices which need to apply voltages other than zero volts to both of the selected and the non-selected display picture elements.

Although the invention has been shown and described in connection with a certain specific embodiment, it will be readily apparent to those skilled in the art that various changes in form and arrangement of parts may be made to suit requirements without departing from the spirit and scope of the invention.

What is claimed is:

1. In a display device having a phase transition mode liquid crystal sandwiched between display electrodes and a common electrode, and a driving circuit for driving the phase transition mode liquid crystal, the improvement comprising: said driving circuit including means for generating and applying to the display and common electrodes two square voltage waves, one of which has an effective voltage to place said liquid crystal in a homeotropic state and a first predetermined interval of zero volts level between successive waves, the other of which has an effective voltage to place said liquid crystal in a focal-conic state and a second predetermined interval of zero volts level between successive waves, the effective voltages of the two square voltage waves being dependent on the first and second predetermined intervals of zero volts level and the first and second predetermined intervals of zero volts level being determined independently of one another.

2. In combination: a display section comprising a pattern of display electrodes disposed in spaced-apart relationship with respect to a common electrode, and a phase transition mode liquid crystal material interposed between the display and common electrodes and having a homeotropic state in which the material exhibits a transparent characteristic when a relatively strong electric field is applied thereto and having a focal-conic state in which the material exhibits a light-scattering characteristic when a relatively weak electric field is applied thereto; and driving means for driving the display section to cause the pattern of display electrodes to display desired information, the driving means including voltage generating means for generating and applying a first square wave voltage between the common electrode and selected ones of the display electrodes effective to place the corresponding sandwiched regions of the phase transition mode liquid crystal material in the homeotropic state and for generating and applying a second square wave voltage between the common electrode and the remaining non-selected one of the display electrodes effective to place the corresponding sandwiched regions of the phase transition mode liquid crystal in the focal-conic state, the first square wave voltage comprising a succession of square voltage waves each separated from the next by a first predetermined time interval of zero volts level and the second square wave voltage comprising a succession of square voltage waves each separated from the next by a second predetermined time interval of zero volts level, the first and second predetermined time intervals being determined independently of one another.

3. The combination according to claim 2; wherein the first square wave voltage has a waveform effective to apply to the phase transition mode liquid crystal material an effective voltage $V_O=V_N(1-\tau 1/T)^{\frac{1}{2}}$ where $V_N$ is fixed voltage level corresponding to the amplitude of the first square wave voltage, T is the period of the first square wave voltage and $\tau_1$ is a predetermined time interval during which the effective voltage $V_O$ is zero, and wherein the second square wave voltage has a waveform effective to apply to the phase transition mode liquid crystal material an effective voltage $V_1$ defined by the relationship $V_1=V_M(1=\tau 2/T)^{\frac{1}{2}}$ where $V_M$ is a fixed voltage level greater than zero but less than $V_N$ and corresponding to the amplitude of the second square wave voltage, T is the period of the second square wave voltage and $\tau_2$ is a predetermined time interval during which the effective voltage $V_1$ is zero.

4. The combination according to claim 3; further including a power source having a given power source voltage for powering the driving means; and wherein the fixed voltage levels $V_N$ and $V_M$ are integral multiples or integral fractions of the given power source voltage.

5. The combination according to claim 4; wherein the predetermined time intervals $\tau_1$ and $\tau_2$ are sufficiently long to enable discharge of electric charge accumulated in the phase transition mode liquid crystal material between the display and common electrodes to the power source thereby conserving power consumption.

* * * * *